US005749409A

United States Patent [19]

Siak et al.

[11] Patent Number: 5,749,409

[45] Date of Patent: May 12, 1998

[54] METHOD OF FORMING REFRACTORY COATED FOUNDRY CORE

[75] Inventors: June-Sang Siak; Scott William Biederman, both of Troy; William Thomas Whited, Saginaw; Mark Allen Datte, Auburn, all of Mich.

[73] Assignee: General Motors Corporation, Detroit, Mich.

[21] Appl. No.: 573,646

[22] Filed: Dec. 18, 1995

[51] Int. Cl.[6] ..... B22C 3/00; B22C 9/10

[52] U.S. Cl. ..... 164/23; 164/138; 427/134

[58] Field of Search ..... 164/12, 14, 23, 164/33, 138; 427/134

[56] References Cited

U.S. PATENT DOCUMENTS

| | | | |
|---|---|---|---|
| 2,313,674 | 3/1943 | Salzberg et al. . | |
| 2,908,952 | 10/1959 | Benham . | |
| 4,529,028 | 7/1985 | Dybala et al. | 164/14 X |
| 4,774,990 | 10/1988 | Yamamoto et al. | 164/14 |
| 4,777,002 | 10/1988 | Putz | 164/23 X |
| 4,834,165 | 5/1989 | Egoshi et al. | 164/14 |
| 4,873,114 | 10/1989 | Harris | 427/134 X |
| 4,934,440 | 6/1990 | Sakakibara et al. | 164/14 |
| 5,320,157 | 6/1994 | Siak et al. | 164/12 |

FOREIGN PATENT DOCUMENTS

| | | | |
|---|---|---|---|
| 2838845 | 3/1979 | Germany | 164/14 |

*Primary Examiner*—J. Reed Batten, Jr.
*Attorney, Agent, or Firm*—Lawrence B. Plant

[57] ABSTRACT

Refractory coated gelatin-bonded foundry sand core made by waterproofing the surface of the core and immersing the waterproofed core in an aqueous refractory suspension to deposit the refractory.

8 Claims, No Drawings

METHOD OF FORMING REFRACTORY COATED FOUNDRY CORE

This invention relates to gelatin-bonded sand foundry cores coated with a refractory coating deposited from an aqueous suspension of such refractory, and more particularly to waterproofing the cores prior to depositing the refractory coating.

BACKGROUND OF THE INVENTION

Expendable sand cores are well known in the foundry art for forming and shaping internal cavities and recesses, or the like, in the finished castings. Such sand cores comprise a plurality of-foundry sand particles bonded together with a suitable binder. Organic binders are the most popular, but tend to so contaminate the sand as to prevent its practical/economical reuse. Costly landfilling or thermal/mechanical reclamation of the sand results. Water soluble, gelatin binders have been proposed (see U.S. Pat. No. Siak et al. 5,320,157, assigned to the assignee of the present invention), and can be used alone or in admixture with certain crystallizeable carbohydrates (e.g., sugar). Gelatin is a proteinaceous material obtained by the partial hydrolysis of collagen, the chief protein component of skin, bone, hides and white connective tissue of animals and is essentially a heterogeneous mixture of polypeptides comprising amino acids including primarily glycine, proline, hydroxyproline, analine, and glutamic acid, with smaller amounts of other amino acids also present. Gelatin is desirable as a binder because it is water soluble, environmentally benign, less costly than the synthetic resins typically used as binders, and has a low thermal degradation temperature.

It is well known to coat sand cores for a variety of reasons including to enhance the surface finish thereof, to prevent penetration of the sand by the molten metal, to protect the core from heat damage, and to prevent excessive chilling of the casting. Such coatings typically contain refractory and other materials. Zirconium oxide, zirconium silicate, magnesium oxide, olivine, chromate, pyrophyllite, talc, carbon, silicon dioxide, magnesium/calcium oxide, mullite (i.e., aluminum silicate), mica, iron oxide, and magnesite are common ingredients for such coatings. Liquid (i.e., organic or aqueous) suspensions of these refractories have been applied to the cores by brushing, spraying, or dipping. For cost and environmental reasons, many foundries prefer to use aqueous suspensions of the refractories to coat their cores. Such aqueous suspensions contain a variety of clays which not only help to keep the refractory particles in suspension, but also serve as binders for the refractory particles after the coating has dried. Unfortunately, aqueous suspensions can not be used directly on sand cores employing water soluble gelatin binders without disintegrating the core.

SUMMARY OF THE INVENTION

The present invention contemplates a foundry core comprising a mass of foundry sand particles bound together by a water-soluble gelatin, an organic waterproofant penetrating and sealing off the surface of the core, and a topcoat of refractory particles and clay deposited on the waterproofed surface from an aqueous suspension of the refractory particles. The core is made by mixing a mass of foundry sand with the gelatin and water, followed by shaping and curing the mix. Thereafter, an organic waterproofing agent is deposited on, and so impregnates the surface of, the core as to seal the surface sufficiently against water invasion that the core may be subsequently coated with an aqueous suspension of refractory particles and clay without deterioration of the core. Preferably, dry waterproofant particles are applied to the surface of the core from an aerosol of such particles, followed by in situ melting and coalescence of the particles.

DETAILED DESCRIPTION OF THE INVENTION

A foundry core comprises a mass of gelatin-bonded foundry sand particles, an organic waterproofant penetrating and sealing off the surface of the core, and a topcoat of refractory particles and clay adhering to the waterproofed surface. As used herein, the term "foundry sand" is intended to include those granular materials that are commonly used in the foundry industry to make molds and/or cores, and hence is not limited to silica, but rather also includes such other popular materials as zircon, olivine, alumina, and other granular ceramics. The preferred waterproofant comprises a aerosol-coated thermoplastic which is melted into the surface of the core and has a melting point between about 80° C. and about 170° C. (i.e., the cross-linking temperature of the gelatin), and most preferably from about 100° C. to about 160° C. Such preferred thermoplastics will also have viscosities (i.e., at processing temperatures) which are not so thin and watery as to cause the core to completely absorb them at processing temperatures, and not so thick as to prevent their ready coalescence and penetration of the surface of the core at such temperatures to achieve a continuous water barrier. The term "thermoplastic" is used herein in the broad sense of a material which softens when heated and returns to its original state when cooled to room temperature. Hence, the term is not limited just to high polymers, but also includes both natural and synthetic organic substances that exhibit such behavior. Most preferably, the thermoplastic particles comprise either a synthetic rosin such as a fatty acid dimmer-based polyamide resin having a melting of about 105° C., or cellulose acetate-butyrate having a melting point of about 135° C. Alternative thermoplastic waterproofants include cellulose acetate, biodegradable polyesters (e.g., poly β hydroxyl alkanoates), and waxes such as paraffin, microcrystalline, polyethylene, and investment (i.e., used in "lost wax" investment molding process) waxes.

The core is made by mixing a mass of foundry sand with the gelatin and a little water, and thereafter shaping and curing the mix such as, for example, is described in U.S. Pat. No. 5,320,157, supra. After the gelatin-bound core is formed, an organic, waterproofing agent is deposited on to the surface of the core by any of a variety of water-free techniques including spraying, brushing, or dipping. In one embodiment of the invention, the waterproofant is carried (i.e., dissolved or suspended) in a liquid vehicle which is a non-solvent for the gelatin in the core, and the liquid subsequently evaporated off. Preferably, however, water-insoluble, thermoplastic, waterproofing particles are applied dry, and subsequently melted into the surface of the core. More preferably, the thermoplastic particles will be deposited from an aerosol of fine (i.e., less than about 50 microns) particles as, for example, by spraying the core with a stream of the particles, or immersing the core in a fluidized bed of the particles. Electrostatic spraying is preferable to uncharged spraying, and "tribo-electric" charging of the particles is preferable to high voltage charging because of its ability to better coat recessed regions of the core. "Tribo-electric" charging is well known in the powder coating art and involves charging of the particles with an electric charge solely by means of friction. This is typically accomplished by passing the particles suspended in a carrier gas through a charging tube and directing the effluent therefrom toward an electrically grounded target (i.e., the core) to be coated.

Gelatin-bonded sand cores are not themselves good electrical conductors, and hence are difficult to ground. However, the surface of the cores can be rendered sufficiently conductive for grounding by briefly exposing the surface to a mist of water which reacts with the amino and carboxyl groups of the gelatin at the surface to render the surface conductive. The core may also be preheated to about the softening point of the thermoplastic particles before contact with the aerosol to accelerate the process, and promote adhesion of the particles to the core.

Following deposition of the thermoplastic particles, the coated core is heated to above the melting point of the thermoplastic particles for a sufficient time to cause the particles to melt, and penetrate the surface of, the core a few sand grains deep so as to seal/waterproof such surface. Thereafter, the thusly sealed/waterproofed core is cooled and then contacted (e.g., sprayed, brushed, or dipped) with an aqueous suspension of refractory and clay particles to deposit one or more layers of the refractory particles atop the waterproofed surface. Any commercially available water-based refractory coating material can be used including Velvaplast (from Ashland Chemical Co.), Technikoat (from Delta Resins Co.) and BXWS Series of coatings (from Borden, Inc.). Finally, the refractory coated core is dried, leaving a layer of clay-bonded refractory particles adhering to the surface of the core. While ambient temperature drying is possible, accelerated drying will preferably be effected at elevated temperatures below the cross-linking temperature of the gelatin binder in the core (i.e., ca. 170° C.). Where a thicker refractory coating is desired, a second refractory layer may be deposited by repeating the refractory coating and drying steps. Similarly where more waterproofing is desired, the waterproofing steps may be repeated to deposit more waterproofant on the surface of the core.

SPECIFIC EXAMPLES

Several dog-bone-shaped cores were made from lake sand and 0.75% by weight gelatin binder, waterproofed and immersed in water to evaluate their water resistance. Water immersion is a more aggressive/rigorous test for core durability than immersion in a water-based refractory suspension which typically contains about 45%–50% by weight solids, and has much of its water tied up with the solids and unavailable to react with the gelatin.

Example I

Three cores were electrostatically spray coated at room temperature with a single layer of cellulose acetate butyrate (i.e., CAB-551-0.2 from Eastman Chemical Co.) from a tribo-electric powder sprayer Model Airstatic-TS I (TS2X1) from the Advanced Powder Coatings Co. The cellulose acetate butyrate had a melting point of about 135° C., and a viscosity of about 76 centipoise (ASTM D 1343 w/Formula A, ASTM D817). One of the cores weighed 104.778 g. Prior to coating, (1) the butyrate powders were screened to provide a mass having particle sizes less than 50 microns, (2) the core was exposed to a light mist of water to render the surface thereof conductive, and (3) the core appropriately electrically grounded. Air pressure of about 60 psi to about 70 psi was used in the sprayer, and spraying continued until the cores were visually completely covered. Thereafter, the cores were heated in a forced air oven at 143° C. for approximately one hour and fifteen minutes until the coatings thereon became transparent followed by cooling to room temperature. After cooling, the weighed sample weighed 105.674 g, of which 0.896 g was the butyrate waterproofant. The thusly coated cores were tested for resistance to water attack along with identical cores that had not been waterproofed (i.e., reference samples). In this test, the several samples were immersed about three quarters of their length in room temperature water and times recorded when significant changes to the sample were observed. The untreated reference samples began to darken after about 2 seconds and completely disintegrated after about 7 seconds in the water. The waterproofed samples, on the other hand, began to discolor in some areas after 20 seconds (i.e., likely due to some water penetration), but remained strong in those areas throughout the test. Moreover, the treated samples remained in tact and strong after four minutes in the water, which is more than enough time to coat the core with refractory slurry, drain and dry it.

Example II

Three samples like those described in Example I were coated in the same manner as in Example I, but with two applications of the CAB-551-0.2 waterproofant. One sample weighed 106.122 g at the outset. The cores were heated ala Example I and yielded a weighed core weighing 106.731 g of which 0.609 g was waterproofant. The process was repeated and the cores again coated and heated the same way as for the first coating, and yielded a weighed core having a final total weight of 107.564 g of which 1.442 g was waterproofant. When subjected to the water immersion test, some damp areas appeared after about three minutes, but even after four minutes the cores remained in tact and strong.

Example III

Three room temperature core samples were electrostatically spray coated at room temperature with a single layer of a synthetic rosin (i.e., UniRez 2620 from the Union Camp Co.) from a tribo-electric powder sprayer Model Airstatic-TS I (TS2X1) from the Advanced Powder Coating Co. The rosin had a melting point of 105° C., and a viscosity of 900 CPs/MPa.s at 190° C. Prior to coating, (1) the rosin was chilled with liquid nitrogen, ground and screened to provide a powder mass having particle sizes less than 50 microns, (2) the cores were exposed to a light mist of water to render the surfaces thereof conductive, and (3) the cores appropriately electrically grounded. One core sample weighed 105.028 g at the outset. An air pressure of about 60 psi to about 70 psi was used in the sprayer, and spraying continued until the cores were visually completely covered. Thereafter, the cores were heated in a forced air oven at 113° C. for approximately one half hour until the coatings became transparent followed by cooling to room temperature. After cooling, the weighed sample then weighed 105.922 g, of which 0.894 g was the rosin waterproofant. When subjected to the water immersion test, portions of the cores were discolored (i.e., from water penetration) after about 50 seconds. The cores remained in tact after four minutes though portions of the surface were soft to the touch.

Example IV

Three cores like those described in Example I were coated in the same manner as in Example III, but with two applications of the UniRez 2620 waterproofant. One of the core samples weighed 105.154 g. The cores were heated ala Example III and yielded a weighed core weighing 105.866 g of which 0.712 g was waterproofant. The process was repeated, and the cores again coated and heated the same way as for the first coating and yielded a weighed core having a final total weight of 105.952 g of which 0.798 g was waterproofant. When subjected to the water immersion test, some damp areas appeared on one of the samples after about two minutes, and it broke apart when it was handled after the four minute immersion. The other two samples lasted the full four minutes but one of them broke apart after two minutes. It was concluded that insufficient rosin had been deposited to provide the degree of waterproofing needed.

Example V

Cores like those used for Examples I–IV were waterproofed using a liquid waterproofing solution. A room temperature core was immersed for approximately ten seconds in a solution comprising 98 weight percent acetone (a non-solvent for gelatin) and 2 weight percent natural rosin and then allowed to dry. Upon dipping in water, the core remained in tact for approximately five minutes, after which it started to break apart.

Example VI

Cores like those used for Examples I–IV were waterproofed using a liquid waterproofing solution. A room temperature core was immersed for approximately one minute in a solution comprising ninety (90) weight percent ethyl acetate (a non-solvent for gelatin) and ten (10) weight percent natural rosin and then allowed to dry. Not all of the rosin went into solution and some settled to the bottom of the beaker used. Upon dipping in water, the core remained in tact for approximately five and one half minutes, after which it started to break apart.

Example VII

Cores like those used for Examples I–IV were waterproofed using a liquid waterproofing solution. A room temperature core was immersed for approximately ten seconds in a solution comprising ninety eight (98) weight percent turpentine (a non-solvent for gelatin) and two (2) weight percent natural rosin and then allowed to dry. Upon dipping in a water-based refractory and heating in a forced air oven at 105° C. for about 20–25 minutes, the refractory coating was good and the core was fine.

Example VIII

A room temperature core like that used for Examples I–IV and weighing 153.864 g was coated with a single layer of powdered natural rosin by dipping the core in a bed of the powdered rosin. The core was then heated in a forced air oven at 160° C. for a sufficient time to completely fuse the coating and allow it to penetrate the surface of the core. After cooling to room temperature, the core weighed 154.044 g of which 0.180 g comprised rosin. The core was then heated in an oven at approximately 105° C. and dipped into a room temperature, water-based, refractory, coating, suspension (i.e., Ashland Chemical Co. MGW 6090), and returned to the oven for drying. Visual inspection of the coated core following drying revealed no deterioration of the core.

Example IX

A room temperature core like that used for Examples I–IV and weighing 153.774 g was coated with two applications of powdered natural rosin by dipping the core in a bed of the powdered rosin. After each application, the core was heated in a forced air oven at 160° C. for a sufficient time to completely fuse the coating and allow it to penetrate the surface of the core. After cooling of the first application, the core weighed 153.966 g, and after cooling of the second application the core weighed 154.342 g of which 0.568 g comprised rosin. The core was then dipped at room temperature into a room temperature, water-based, refractory, coating, suspension (i.e., Ashland Chemical Co. MGW 6090), and placed in a forced air oven fat approximately 105° C. for about fifteen minutes for drying. Visual inspection of the coated core following drying revealed no deterioration of the core.

Example X

Another sample waterproofed and refractory coated as in Example IX, but allowed to air dry at room temperature had a moist refractory coating at the end of fifteen minutes, but the core remained hard and strong.

While the invention has been described in terms of certain specific embodiments thereof it is not intended to be limited thereto but rather only to the extent set forth hereafter in the claims which follow.

What is claimed is:

1. A method of making a coated foundry core comprising the steps of shaping and curing a mixture of foundry sand and water-soluble gelatin into a core having a desired configuration, permeating and sealing a surface of said core with a water-insoluble substance so as to form a water impermeable barrier at said surface, contacting said surface with an aqueous suspension of refractory particles to deposit a layer of said refractory particles atop said barrier, and drying said layer to adhere said refractory particles to said surface.

2. A method according to claim 1 including the steps of dissolving said substance in a solvent which is a non-solvent for said gelatin to form a waterproofing solution, wetting said surface of said core with said solution, and evaporating said solvent to deposit said substance in said surface of said core.

3. A method of making a coated foundry core comprising the steps of shaping and curing a mixture of foundry sand and water-soluble gelatin into a core having a desired configuration, depositing a first layer of water-insoluble thermoplastic particles on a surface of said core, heating said core sufficiently to cause said thermoplastic particles to fuse and penetrate said surface of said core so as to form a water impermeable barrier at said surface, contacting said surface with an aqueous suspension of refractory particles to deposit a second layer of said refractory particles atop said barrier, and drying said second layer to adhere said refractory particles to said surface.

4. A method according to claim 3 wherein said thermoplastic particles are deposited onto said core from an aerosol of such particles.

5. A method according to claim 4 wherein said aerosol comprises a fluidized bed of said thermoplastic particles, and said core is immersed in said bed to deposit said first layer.

6. A method according to claim 3 wherein said thermoplastic particles are electrostatically sprayed onto said surface.

7. A method according to claim 3 including the step of preheating said core before contacting it with said thermoplastic particles to promote adhesion of said thermoplastic particles to said core upon contact therewith.

8. A method according to claim 7 wherein said preheating is to a temperature near the melting point of said thermoplastic particles.

* * * * *